United States Patent [19]

Jolley

[11] Patent Number: 4,992,188

[45] Date of Patent: Feb. 12, 1991

[54] TERTIARY AMIDE-CONTAINING COMPOSITIONS FOR REFRIGERATION SYSTEMS

[75] Inventor: Scott T. Jolley, Mentor, Ohio

[73] Assignee: The Lubrizol Corporation, Wickliffe, Ohio

[21] Appl. No.: 502,610

[22] Filed: Mar. 30, 1990

[51] Int. Cl.[5] ..... C10M 105/68

[52] U.S. Cl. ..... 252/51.5 A; 252/67; 252/68

[58] Field of Search ..... 252/67, 32, 68, 51.5 A

[56] References Cited

U.S. PATENT DOCUMENTS

| | | | |
|---|---|---|---|
| 4,428,854 | 1/1984 | Enjo et al. | 252/69 |
| 4,559,154 | 12/1985 | Powell | 252/69 |
| 4,755,316 | 7/1988 | Magid et al. | 252/68 |

*Primary Examiner*—Paul Lieberman
*Assistant Examiner*—William S. Parks
*Attorney, Agent, or Firm*—Robert A. Franks; Frederick D. Hunter; Forrest L. Collins

[57] ABSTRACT

This invention relates to a composition comprising:

(A) a major amount of a fluorine-containing hydrocarbon containing one or two carbon atoms; and (B) a minor amount of a soluble tertiary amide represented by the formula

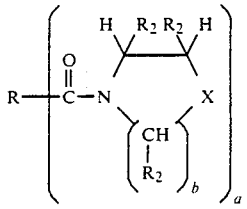

wherein a is one or two, provided that when a is one, R is a hydrocarbyl group or a hydrocarbylpolyoxyalkylene group, and when a is two, R is a hydrocarbylene group;

each $R_2$ is independently hydrogen or an alkyl group having from 1 to about 8 carbon atoms;

b is one or two;

X is oxygen or N—$R_3$;

$R_3$ is a hydrocarbyl group having 1 to about 18 carbon atoms or —C(O)$R_4$, $R_4$ is a hydrocarbyl group or a hydrocarbylpolyoxyalkylene alkyl group.

The present invention provides compositions which are useful as refrigeration liquids in refrigerators and air-conditioners including auto, home and industrial air-conditioners. The invention provides tertiary amides which are compatible with fluorine-containing hydrocarbons used in refrigerators and air conditioners. The tertiary amides act as a lubricant for air-conditioners.

12 Claims, No Drawings

TERTIARY AMIDE-CONTAINING COMPOSITIONS FOR REFRIGERATION SYSTEMS

FIELD OF THE INVENTION

This invention relates to compositions for refrigeration systems. More particularly, the compositions contain tertiary amide compounds and are useful as synthetic lubricants in liquid compositions containing fluorine-containing hydrocarbons.

BACKGROUND OF THE INVENTION

Chlorofluorocarbons, generally referred to in the industry as CFCs, have been widely used in refrigeration systems. The use of CFCs has been diminishing in recent years because of demands from environmentalists for the reduction if not complete ban of the use of CFCs because of the detrimental effect of CFCs on the atmosphere's ozone layer. Examples of CFCs include CFC-11 which is chlorotrifluoromethane, CFC-12 which is dichlorodifluoromethane, and CFC-113 which is 1, 2, 2-trifluoro-1, 1, 2-trichloroethane. Finding a safe replacement of CFC refrigerants has been a problem which has been difficult to solve. Several replacement candidates have been suggested as alternatives to the fully halogenated hydrocarbons. Examples of safe alternatives include halogenated hydrocarbons containing at least one hydrogen atom such as HCFC-22 which is difluorochloromethane, HCFC-123 which is 1,1-dichloro-2,2,2-trifluoroethane, HFC-134a which is 1,1,1,2-tetrafluoroethane, and HCFC-141b which is 1,1-dichloro-1-fluoroethane.

The ozone depletion potential of these proposed substitutes is significantly less than the ozone depletion potential of the previously used CFCs. Ozone depletion potential is a relative measure of a capability of a material to destroy the ozone layer in the atmosphere. HCFC-22 and HFC-134a generally are recommended as being candidates in refrigerant applications, and HFC-134a is particularly attractive because its ozone depletion potential has been reported as being zero.

The problem with using these alternative materials is that the alternative materials have different solubility characteristics than the CFCs used in refrigerants presently. For example, mineral lubricating oil is incompatible (i.e., insoluble) in HFC-134a. Such incompatibility results in unacceptable compressor life in compressor-type refrigeration equipment including refrigerators and air-conditioners including auto, home and industrial airconditioners. The problem is particularly evident in auto air-conditioning systems since the compressors are not separately lubricated, and the mixture of refrigerant and lubricant circulates throughout the entire system.

In order to perform as a satisfactory refrigeration liquid, the mixture of refrigerant and lubricant must be compatible and stable over a wide temperature range such as from about −20° C. and above 80° C. It is generally desirable for the lubricants to be soluble in the refrigerant at concentrations of about 5 to 15% over a temperature range of from −40° C. to 80° C. These temperatures generally correspond to the working temperatures of an automobile air-conditioning compressor. In addition to thermal stability, the refrigeration liquids must have acceptable viscosity characteristics which are retained even at high temperatures, and the refrigeration liquid should not have a detrimental effect on materials used as seals in the compressors.

U.S. Pat. No. 4,755,316, issued to Magid et al, relates to lubricants for refrigeration systems using tetrafluoroethane. The patent describes certain polyoxyalkylene glycols as lubricating oils. Magid et al disclose additives which may be used to enhance performance. Among the additives listed are organic amines.

U.S. Pat. No. 4,559,154, issued to Powell, relates to working fluids for heat pumps of the absorption type. Solvents may be used with the working fluids. Such solvents include ethers, such as tetraglyme, amides which may be lactams such as N-alkyl pyrrolidones, for example N-methylpyrrolidones, sulphonamides, for example tetramethylsulphamide and ureas including cyclic ureas.

U.S. Pat. No. 4,428,854, issued to Enjo et al, relates to an absorption refrigerant composition comprising 1,1,1,2-tetrafluoroethane and an organic solvent capable of dissolving the ethane. N,N-dimethylformamide, N,N-dimethylacetoamide, tetramethylurea, acetonitrile, valeronitrile, N-methylpyrrole, N-methylpyrrolidine, piperidine, N-methylpiperazine, N-methyl-2-pyrrolidone, nitromethane and like nitrogen compound solvents are disclosed as solvents capable of dissolving the ethane.

SUMMARY OF THE INVENTION

This invention relates to a composition comprising:

(A) a major amount of a fluorine-containing hydrocarbon containing one or two carbon atoms; and (B) a minor amount of a soluble tertiary amide represented by the formula

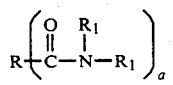

(I)

or

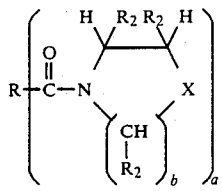

(II)

wherein a is one or two, provided that when a is one, R is a hydrocarbyl group or a hydrocarbylpolyoxyalkylene group, and when a is two, R is a hydrocarbylene each $R_1$ is independently a hydrocarbyl group, a hydrocarbyl terminated polyoxyalkylene group, or taken together form a pyrrolidinyl group provided that in Formula I, when a is one, R has one carbon atom and $R_1$ is a hydrocarbyl group, then $R_1$ has at least eight carbon atoms;

each $R_2$ is independently hydrogen or an alkyl group having from 1 to about 8 carbon atoms;

b is one or two;

X is oxygen or N—$R_3$;

$R_3$ is a hydrocarbyl group having 1 to about 18 carbon atoms or —C(O)$R_4$, $R_4$ is a hydrocarbyl group or a hydrocarbylpolyoxyalkylene alkyl group.

The present invention provides compositions which are useful as refrigeration liquids in refrigerators and air-conditioners including auto, home and industrial air-conditioners. The invention provides tertiary amides which are compatible with fluorine-containing hydrocarbons used in refrigerators and air-conditioners. The tertiary amides act as a lubricant for air-conditioners.

DETAILED DESCRIPTION OF THE INVENTION

In the specification and claims, unless the context indicates otherwise, the use of the term alkyl or hydrocarbyl group is meant to encompass all isomeric arrangements of the group, such as primary, secondary, and tertiary arrangements of the group.

In the specification and claims, the use of the term alkylene or hydrocarbylene is meant to encompass divalent hydrocarbon or hydrocarbyl groups. For instance, propylene is a divalent hydrocarbon group having 3 carbon atoms.

Throughout this specification and claims, all parts and percentages are by weight, temperatures are in degrees Celsius, and pressures are at or near atmospheric unless otherwise clearly indicated.

The term "hydrocarbyl" includes hydrocarbon, as well as substantially hydrocarbon, groups. Substantially hydrocarbon describes groups which contain non-hydrocarbon substituents which do not alter the predominantly hydrocarbon nature of the group. Non-hydrocarbon substituents include halo (especially chloro and fluoro), hydroxy, alkoxy, mercapto, alkylmercapto, nitro, nitroso, sulfoxy, etc., groups.

The hydrocarbyl group may also contain a hetero atom, such as sulfur, oxygen or nitrogen, in a ring or chain. In general, no more than about 2, preferably no more than one, non-hydrocarbon substituents will be present for every ten carbon atoms in the hydrocarbyl group. Typically, there will be no such non-hydrocarbon substituents in the hydrocarbyl group. Therefore, the hydrocarbyl group is purely hydrocarbon.

The term "lower" as used herein in conjunction with terms such as hydrocarbyl, alkyl, alkenyl, alkoxy, and the like, is intended to describe such groups which contain a total of up to 7 carbon atoms.

(A) Fluorine—Containing Hydrocarbon

The fluorine-containing hydrocarbon present in the liquid compositions contains at least one C—H bond as well as C—F bonds. In addition to these two essential types of bonds, the hydrocarbon also may contain other carbon-halogen bonds such as C—Cl bonds. Because the liquid compositions of the present invention are primarily intended for use as refrigerants, the fluorine-containing hydrocarbon preferably contains one or two carbon atoms, and more preferably two carbon atoms.

As noted above, the fluorine-containing hydrocarbons useful in the liquid compositions of the present invention may contain other halogens such as chlorine. However, in one preferred embodiment, the hydrocarbon contains only carbon, hydrogen and fluorine. These compounds containing only carbon, hydrogen and fluorine are referred to herein as fluorohydrocarbons (hydrofluorocarbons or HFCs). The hydrocarbons containing chlorine as well as fluorine and hydrogen are referred to as chlorofluorohydrocarbons (hydrochlorofluorocarbons or HCFCs). The fluorine-containing hydrocarbons useful in the composition of the present invention are to be distinguished from the fully halogenated hydrocarbons which have been and are being used as propellants, refrigerants and blowing agents such as CFC-11, CFC-12 and CFC-113 which have been described in the background.

Specific examples of the fluorine-containing hydrocarbons useful in the liquid compositions of the present invention, and their reported ozone depletion potentials are shown in the following Table I.

TABLE I

| Compound Designation | Formula | ODP* |
|---|---|---|
| HCFC-22 | $CHClF_2$ | 0.05 |
| HCFC-123 | $CHCl_2CF_3$ | <0.05 |
| HCFC-141b | $CH_3CCl_2F$ | <0.05 |
| HFC-134a | $CH_2FCF_3$ | 0 |

*Ozone depletion potential as reported in Process Engineering, pp. 33-34, July, 1988.

Examples of other fluorine-containing hydrocarbons which may be useful in the liquid compositions of the present invention include trifluoromethane, 1,1,1-trifluoroethane, 1,1-difluoroethane, and 1,1,2,2-tetrafluoroethane.

In general, fluorine-containing hydrocarbons which are useful as refrigerants are fluoromethanes and fluoroethanes boiling at a relatively low temperature at atmospheric pressure, e.g., below 30° C. The useful fluorocarbon refrigerants serve to transfer heat in a refrigeration system by evaporating and absorbing heat at a low temperature and pressure, e.g., at ambient temperature and atmospheric pressure, and by releasing heat on condensing at a higher temperature and pressure.

The liquid compositions of the present invention contain a major amount of the fluorine-containing hydrocarbon. More generally, the liquid compositions will comprise greater than about 50% up to about 99% by weight of the fluorine-containing hydrocarbon. In another embodiment, the liquid compositions contain from about 70% to about 99% by weight of the fluorine-containing hydrocarbon.

(B) Tertiary Amides

In addition to the fluorine-containing hydrocarbon, the compositions of the present invention comprise a soluble tertiary amide described above. Preferably the tertiary amide has a total of not more than twenty-four carbon atoms per carbonyl group, excluding carbon atoms in the polyoxyalkylene groups.

In Formulae I and II, a is one or two. When a is one, R is a hydrocarbyl group, or a hydrocarbylpolyoxyalkylene alkyl group. Preferably, R is a hydrocarbyl group having 1 to about 18 carbon atoms, more preferably 1 to about 16, more preferably 1 to about 14. Preferably R is a straight-chain hydrocarbyl group having from 1 to about 10 carbon atoms, more preferably 1 to about 8; or a branched-chain hydrocarbyl group having from 3 to about 16 carbon atoms, preferably 4 to about 16, more preferably 6 to about 16. Preferably, R is an alkyl group. Examples of R include methyl, ethyl, propyl, isopropyl, butyl, isobutyl, hexyl, 2-ethylhexyl, octyl, isooctyl, nonyl, isononyl, decyl, isodecyl, and isotridecyl groups.

In another embodiment, R is a hydrocarbylpolyoxyalkylene alkyl group. The hydrocarbyl portion of the hydrocarbylpolyoxyalkylene alkyl group is defined the same as R when R is a hydrocarbyl group above. Preferably R contains an average of 2 to about 20 oxyalkylene groups, more preferably 2 to about 12, more preferably 3 to about 10. The alkylene portion of the hydrocarbylpolyoxyalkylene alkyl group is ethylene, propylene, butylene, or mixtures of two or more thereof, preferably ethylene, propylene or mixtures thereof. Typically the alkyl portion of the group contains from 1 to about 12 carbon atoms, more preferably 1 to about 6, more preferably 1 or 2. Examples of alkyl groups include methyl, ethyl, propyl or butyl groups, preferably a methyl group.

When a is 2, R is a hydrocarbylene group. Preferably, R contains from 0 to about 20 carbon atoms, preferably 2 to about 16, preferably 2 to about 10. R may be preferably an alkylene group Examples of alkylene groups include ethylene and butylene.

Each $R_1$ is independently a hydrocarbyl group, a hydrocarbyl terminated polyoxyalkylene group, or taken together form a pyrrolidinyl group, provided that in Formula I when a is one, R has one carbon atom and $R_1$ is a hydrocarbyl group, $R_1$ has at least eight carbon atoms. When $R_1$ is a hydrocarbyl group it is defined the same as R when R is a hydrocarbyl group. When $R_1$ is a hydrocarbyl terminated polyoxyalkylene group, the hydrocarbyl portion of the group is defined the same as R when R is a hydrocarbyl group. Preferably, $R_1$ contains an average of 1 to about 50 oxyalkylene groups, more preferably 2 to about 30, more preferably 2 to about 20, more preferably about 3 to about 10. Preferably the oxyalkylene groups include oxyethylene, oxypropylene, oxybutylene or mixtures thereof, more preferably oxyethylene, oxypropylene or mixtures thereof.

Each $R_2$ is independently hydrogen or an alkyl group having from 1 to 8 carbon atoms, more preferably 1 to 6, preferably 1 or 2. Each $R_2$ is independently a hydrogen, a methyl, ethyl or propyl group, more preferably hydrogen or a methyl group.

$R_3$ is a hydrocarbyl group or —C(O)$R_4$. When $R_3$ is a hydrocarbyl group, $R_3$ is defined the same as R when R is a hydrocarbyl group.

$R_4$ is a hydrocarbyl group or a hydrocarbylpolyoxyalkylene alkyl group. When $R_4$ is a hydrocarbyl group, $R_4$ is defined the same as R when R is a hydrocarbyl group. When $R_4$ is a hydrocarbylpolyoxyalkylene alkyl group, $R_4$ is defined the same as R when R is a hydrocarbylpolyoxyalkylene alkyl group.

b is one or two, preferably two. X is oxygen or N—$R_3$ wherein $R_3$ is defined above. In one embodiment, b is two and X is oxygen. In another embodiment, b is two and X is N—$R_3$.

The above tertiary amides are prepared by reacting a carboxylic acid or anhydride and at least one secondary amine. Preferably, the carboxylic acid is represent formula $R_5$—$(C(O)OH)_a$ wherein a is one or two, provided that when a is one, $R_5$ is a hydrocarbyl group or a hydrocarbylpolyoxyalkylene alkyl group. When a is two, $R_5$ is a hydrocarbylene group. $R_5$ is defined the same as R when R is a hydrocarbyl group. In one embodiment, $R_5$ is a branched-chain carboxylic acid or a straight-chain carboxylic acid. Examples of branched-chain carboxylic acids include isoheptyl, 2-ethylhexyl, isooctyl, isononyl, isodecyl, isododecyl and isotridecyl carboxylic acids. Straight chain carboxylic acids include ethanoic acid, propionic acid, butanoic acid, pentanoic acid, hexanoic acid and octanoic acid.

In another embodiment, the carboxylic acid may be a hydrocarbylpolyoxyalkylene alkyl substituted carboxylic acid. These carboxylic acids are represented by the formula:

$$R_6-O(\overset{R_7}{\overset{|}{C}}H-\overset{R_7}{\overset{|}{C}}H-O)_t-\overset{R_8}{\overset{|}{C}}H-\overset{O}{\overset{\|}{C}}-OH$$

wherein $R_6$ is a hydrocarbyl group having from 1 to about 24 carbon atoms, preferably 1 to about 18; each $R_7$ is independently hydrogen or an alkyl group having from 1 to about 10 carbon atoms, preferably hydrogen or a methyl group; t is an average of from 1 to about 20, preferably about 2 to about 10; and $R_8$ is hydrogen or an alkyl group having from 1 to about 10 carbon atoms, preferably hydrogen or a methyl group. Carboxylic acids of this kind are available commercially from Sandoz Chemical Company under the tradename Sandopan. Isostearylpentaethyleneglycol-acetic acid is an example of this type of carboxylic acid.

In another embodiment, the carboxylic acid is a dicarboxylic acid. The carboxylic acid groups may be in any position on the carboxylic acid. Preferably the carboxylic acid groups are in terminal positions (i.e., the dicarboxylic acids are linear dicarboxylic acids). Examples of dicarboxylic acids include ethanedioic acid, propanedioic acid, butanedioic acid, pentanedioic acid, hexanedioic acid, heptanedioic acid and octanedioic acid, preferably butanedioic acid and hexanedioic acid.

In another embodiment, the dicarboxylic acid is an alkyl substituted succinic acid or anhydride. The alkyl group may be derived from monoolefins having from 2 to about 18 carbon atoms or oligomers thereof. The oligomers are generally prepared from olefins having less than 7 carbon atoms, preferably ethylene, propylene or butylene, more preferably propylene. A preferred oligomer has 12 carbon atoms as a propylene tetramer. Examples of alkyl groups include octyl, isooctyl, isononyl, isodecyl, and isododecyl groups.

The above carboxylic acids or anhydrides are reacted with the secondary amine to form the tertiary amide compounds of the present invention provided that when the carboxylic acid is acetic acid, i.e., when a is one and $R_5$ has one carbon atom in the formula $R_5$—$(C(O)OH)_a$, and the secondary amine is a dialkylamine, then the dialkylamine has alkyl groups having at least eight carbon atoms. The secondary amine compound may be a dialkyl amine, a morpholine, a pyrrolidine, a piperazine, or a piperidine.

The secondary amine is preferably a secondary cycloalkyl or alkyl amine. Each alkyl group independently has from 1 to about 28 carbon atoms, preferably 3 to about 12, more preferably 1 to about 8. Each cycloalkyl group independently contains from 4 to about 28 carbon atoms, more preferably 4 to about 12, more preferably 5 to about 8. Examples of cycloalkyl and alkyl groups include methyl, ethyl, propyl, butyl, amyl, hexyl, heptyl, octyl, cyclopentyl, cyclohexyl, cycloheptyl or cyclooctyl groups. Preferred secondary alkyl amines include but are not limited to dipropyl amine, dibutyl amine, diamyl amine, dicyclohexylamine and dihexylamine.

The heterocyclic secondary amine may be a pyrrolidine, a piperidine, a morpholine or a piperazine. The heterocyclic amine may contain one or more, preferably 1 to 3 alkyl substituents on the heterocyclic ring. The alkyl substituents preferably contain from 1 to about 6 carbon atoms, preferably 1 to about 4, preferably 1. Examples of heterocyclic amines include 2-methylmorpholine, 3-methyl-5-ethylpiperidine, 3-hexylmorpholine, tetramethylpyrrolidine, piperazine, 2,5-dipropylpiperazine, piperidine, 2-butylpiperazine, 3,4,5-triethylpiperidine, 3-hexapyrrolidine and 3-ethyl-5-isopropylmorpholine. Preferably, the heterocyclic amine is a morpholine or a piperidine.

The secondary amines in the carboxylic acid or anhydride are preferably reacted at about a (1:1) equivalent ratio. The reaction temperature is from about 50° C. to about 250° C., preferably 75° C. to about 200° C.

The following examples relate to tertiary amide compounds. The solubility of the tertiary amides in fluorohydrocarbons such as 1,1,1,2-tetrafluoroethane at low temperatures is determined in the following manner. The tertiary amide (0.5 gram) is placed in a thick-walled glass vessel equipped with a removable pressure gauge. The tetrafluoroethane (4.5 grams) is condensed into the cooled (−40° C.) glass vessel, and the contents are warmed to the desired temperature and mixed to determine if the tertiary amide is soluble in the tetrafluoroethane. If soluble, the temperature of the mixture is reduced until a separation and/or precipitate is observed.

EXAMPLE 1

A reaction vessel, equipped with a mechanical stirrer, a thermometer, a water trap and an addition funnel, is charged with 471 parts (3 moles) of diamyl amine. Adipic acid (108 parts, 0.75 mole) is added to the vessel. The reaction mixture is heated to 100° C. and the remaining adipic acid (108 parts, 0.75 mole) is added. The reaction temperature is increased to 200° C. and held for 12 hours, while 45 milliliters of water is collected (theoretical 54). The reaction temperature is increased to 240° C. and maintained for 12 hours. The product is vacuum stripped to 200° C. and 15–25 milli meters of mercury (mm Hg) for four hours. The residue is cooled to 125° C. where 10 g of sodium carbonate is added to the residue. This mixture is filtered. The product has 6.5% nitrogen (theoretical 6.6%) and a specific gravity of 0.923 and a kinematic viscosity at 100° C. of 8.08 centistokes (cSt). The product is soluble in R-134a to about −50° C.

EXAMPLE 2

A vessel, equipped as described in Example 1, is charged with 418 parts (3.2 moles) of di-isobutyl amine, 17 parts (0.1 mole) of piperazine, 252 parts (1.75 moles) of adipic acid, and 2 parts of tetraisopropyltitanate. The mixture is heated to 150° C. and held for 100 hours. The reaction mixture has a neutralization acid number of 30 milligrams of potassium hydroxide (mg KOH). The neutralization number is the amount in milligrams of potassium hydroxide or hydrochloric acid required to neutralize one gram of sample. The reaction temperature is increased to 230° C. and maintained for 12 hours. The neutralization acid number of the reaction mixture is 20 mg KOH and 46 milliliters of water have been collected. Diamyl amine (10 parts, 0.6 mole) is added to the vessel and the reaction is run for 8 hours at 240° C. The product is vacuum stripped at 240° C. and 15–25 mm Hg. The residue is treated with 10 grams magnesium oxide at 150° C. for 2 hours. The product is filtered. The product has 7.73% nitrogen (theoretical 7.93%), an acid number of 9.6 mg KOH and a kinematic viscosity at 100° C. of 11.01 cSt. The product is soluble in R-134a to less than −40° C. (some insolubles present).

EXAMPLE 3

A reaction vessel, equipped as described in Example 1, is charged with 39 parts (0.33 mole) of succinic acid and 421 parts (2.67 moles) of isononanoic acid. The mixture is heated to 100° C. where 261 parts (3 moles) of morpholine and 21.7 parts (0.16 mole) of piperazine are added to the vessel. The reaction temperature is increased to 180° C. and held until the neutralization acid number of the reaction mixture is below 10 mg KOH. The reaction is stripped at 180° C. and 15–25 mm Hg. The residue has 6.26% nitrogen (theoretical 6.5%), a specific gravity of 0.984 and a kinematic viscosity at 100° C. of 3.94 cSt. The product is soluble in R-134a to −50° C.

EXAMPLE 4

A reaction vessel, equipped as described in Example 1, is charged with 707 parts (4.5 moles) of diamyl amine and 362 parts (1.5 moles) of di-2-ethylhexyl amine. Adipic acid (432 parts, 3.0 moles) is added slowly to the reaction mixture. The reaction mixture forms a solid. The solid is warmed to 60° C. and stirring is begun. The reaction temperature is then increased to 200° C. The reaction is stripped at 220° C. and 15–25 mm Hg. The residue is filtered through diatomaceous earth. The product has 6.11% nitrogen (theoretical 6.03%), a kinematic viscosity at 100° C. of 8.98 cSt, an acid number of 4.2 mg KOH and a base number of 3.3 mg HCl. The product is soluble in R-134a to −40° C.

EXAMPLE 5

A reaction vessel, equipped as described in Example 1, is charged with 1580 parts (10 moles) of isononanoic acid and 3 parts of tetraisopropyltitanate. Morpholine (870 parts, 10 moles) is added to the vessel. The reaction is exothermic and the reaction temperature increases to 70° C. The reaction mixture is heated to reflux to about 150° C. The refluxate is removed as generated. Refluxing ceases after approximately 350 milliliters of refluxate has been removed. The reaction mixture is cooled and 200 parts (2.3 moles) of morpholine is added to the reaction vessel. The reaction temperature is increased to 240° C. and 100 milliliters of refluxate is removed. Then, 50 parts (0.6 mole) of morpholine is added to the reaction mixture and the reaction is run for 24 hours at 240° C. The reaction mixture has a neutralization acid number of 7 mg KOH. The product is cooled to 150° C. and 10 grams of potassium hydroxide is added to the reaction mixture. The reaction is then distilled. The distillate is a clear oil and distilled quickly at 180° C. and 30 mm Hg. The distillate is mixed with magnesium sulfate and filtered. The product has 6.04% nitrogen (theoretical 6.17%), 3 mg KOH and has a kinematic viscosity at 100° C. of 3.19 cSt. The product is soluble in R-134a to less than −60° C.

EXAMPLE 6

A reaction vessel, equipped as described in Example 1, is charged with 524 parts (2.0 moles) of isotridecanoic acid and 174 parts (2.0 moles) of morpholine. The reaction temperature is increased to 55° C. The reaction temperature is increased to 200° C. where 50 milliliters of light ends are removed. The reaction mixture has an acid number of approximately 80 mg KOH. Morpholine (70 parts, 0.8 mole) is added to the vessel. The reaction is run for 4 hours at 220° C. while 30 milliliters of light ends are removed. The acid number of the reaction mixture is 22 mg KOH. The product is then stripped to 220° C. at 15–25 mm Hg. Ethylenediamine (20 parts, 0.33 mole) is added to the reaction mixture with stirring. The product has 4.8% nitrogen (theoretical 4.2%), an acid number of 8.7 mg KOH, a base number of 4.8 mg HCl, and a kinematic viscosity at 100° C. of 5.0 cSt. The product is soluble in R-134a to less than −40° C.

EXAMPLE 7

A reaction vessel, equipped as described in Example 1, is charged with 482 parts (3.35 moles) of isooctanoic acid. Piperazine (96 parts, 1.1 moles) is added to the reaction vessel. The reaction is exothermic and the reaction temperature increases to 55° C. The reaction temperature is then increased to 100° C. and 48 parts (0.55 mole) of piperazine is added to the vessel. The reaction temperature is increased to 180° C. The neutralization acid number of the reaction mixture is 45 mg KOH. Piperazine (30 parts, 0.35 mole) is added to the reaction mixture. The reaction temperature is increased to 230° C. Excess amine is removed by distillation. The product is a solid at room temperature. The product is soluble in R-134a to −15° C.

EXAMPLE 8

A reaction vessel, equipped as described in Example 1, is charged with 474 parts (3.0 moles) of pelargonic acid and 261 parts (3 moles) of morpholine. The reaction is exothermic and the reaction temperature increases to 40° C. The reaction is then heated to 120° C. and light ends are removed from the reaction while the reaction temperature increases to 200° C. The neutralization acid number of the reaction mixture is approximately 50 mg KOH. Morpholine (75 parts, 0.86 mole) is added to the reaction mixture at room temperature. The reaction mixture is heated to 225° C. and excess amine is removed by distillation. The product is vacuum stripped to 220° C. and 15–25 mm Hg. The residue is filtered through diatomaceous earth. The product has 5.94% nitrogen (theoretical 6.17%), an acid number of 7.5 mg KOH, a base number of 0.5 mg HCl and a kinematic viscosity at 100° C. of 12.5 cSt. The product is soluble in R-134a to −25° C.

The above tertiary amides (B) preferably are free of acetylenic and aromatic unsaturation. Some tertiary amides which contain such unsaturation may be insoluble in the fluorine-containing hydrocarbons and have diminished thermal stability. The soluble tertiary amides of this invention also are preferably free of olefinic unsaturation except that some olefinic unsaturation may be present so long as the tertiary amide is soluble.

The tertiary amides are soluble in fluorine-containing hydrocarbons and, in particular, in the fluorohydrocarbons such as 1,1,1,2-tetrafluoroethane. The tertiary amides are soluble over a wide temperature range and, in particular, at low temperatures.

Typically, the above tertiary amides have a kinematic viscosity at 100° C. of at least about 3 centistokes, preferably about 3 to about 2000, more preferably about 3 to about 20. For automotive air-conditioning systems, the tertiary amides should have a kinematic viscosity at 100° C. of at least about 10 cSt, preferably about 10 to about 2000, more preferably about 10 to about 50.

Liquid Compositions

The liquid compositions of the present invention comprise a major amount of a fluorine-containing hydrocarbon and a minor amount of at least one soluble tertiary amide composition of the types described above. "Major amount" is meant to include an amount equal to or greater than 50% by weight such as 50.5%, 70%, 99%, etc. The term "minor amount" includes amounts less than 50% by weight such as 1%, 5%, 20%, 30% and up to 49.9%. In one embodiment, the liquid compositions of the present invention will comprise from about 70 to about 99% of the fluorine-containing hydrocarbon (A) and from about 0.1% to about 30%, preferably from about 0.5% to about 25%, more preferably from about 1% to about 22% by weight of the tertiary amides (B). Preferably (B) is present in an amount from about 9% to about 25%, more preferably from about 10 to about 20% by weight.

The liquid compositions of the present invention are characterized as having improved thermal and chemical stability over a wide temperature range. Other additives, if soluble in the liquid, known to be useful for improving the properties of halogen-containing hydrocarbon refrigerants can be included in the liquid compositions of the present invention to improve the characteristics of the liquid as a refrigerant. However, hydrocarbon oils such as mineral oil generally are not included in and are most often excluded from the liquid compositions of the invention, particularly when the fluorine-containing hydrocarbon contains no other halogen.

The additives which may be included in the liquid compositions of the present invention to enhance the performance of the liquids include extreme-pressure and anti-wear agents, oxidation and thermal-stability improvers, corrosion-inhibitors, viscosity improvers, pour point and/or floc point depressants, detergents, dispersants, anti-foaming agents, viscosity adjusters, etc. As noted above, these supplementary additives must be soluble in the liquid compositions of the invention. Included among the materials which may be used as extreme-pressure and anti-wear agents are phosphates, phosphate esters, phosphites, thiophosphates such as zinc diorganodithiophosphates, dithiocarbamates, chlorinated waxes, sulfurized fats and olefins, organic lead compounds, fatty acids, molybdenum complexes, borates, halogen-substituted phosphorous compounds, sulfurized Diels Alder adducts, organic sulfides, metal salts of organic acids, etc. Sterically hindered phenols, aromatic amines, dithiophosphates, phosphites, sulfides and metal salts of dithioacids are useful examples of oxidation and thermal stability improvers. Compounds useful as corrosion-inhibitors include organic acids, organic amines, organic alcohols, metal sulfonates, organic phosphites, etc. Viscosity improvers include polyolefins such as polybutene, polymethacrylates, etc. Pour point and floc point depressants include polymethacrylates, ethylene-vinyl acetate copolymers, maleamic acid-olefin copolymers, ethylene-alpha olefin copolymers, etc. Detergents include sulfonates, long-chain alkyl-substituted aromatic sulfonic acids, phosphonates, phenylates, metal salts of alkyl phenols, alkyl phenol aldehyde condensation products, metal salts of substituted salicylates, etc. Silicone polymers are a well known type of anti-foam agent. Viscosity adjusters are exemplified by polyisobutylene, polymethacrylates, polyalkyl styrenes, naphthenic oils, alkyl benzene oils, polyesters, polyvinyl chloride, polyphosphates, etc.

The liquid compositions of the present invention are particularly useful as refrigerants in various refrigeration systems which are compression-type systems such as refrigerators, freezers, and air-conditioners including automotive, home and industrial air-conditioners. The following examples are illustrative of the liquid compositions of the present invention.

| | Parts by Wt. |
|---|---|
| Example A | |
| 1,1,1,2-tetrafluoroethane (R134a) | 90 |
| Product of Example 1 | 10 |
| Example B | |
| 1,1,2,2-tetrafluoroethane | 85 |
| Product of Example 1 | 15 |
| Example C | |
| 1,1,1,2-tetrafluoroethane | 95 |
| Product of Example 2 | 5 |
| Example D | |
| R134a | 80 |
| Product of Example 1 | 20 |
| Example E | |
| R134a | 82.5 |
| Product of Example 2 | 7.5 |

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims

I claim:

1. A composition, comprising:

(A) a major amount of a fluorine-containing hydrocarbon containing one or two carbon atoms; and (B) a minor amount of a soluble tertiary amide represented by the formula

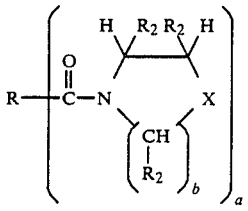

wherein a is one or two, provided that when a is one, R is a hydrocarbyl group or a hydrocarbyl polyolyalkylene group, and when a is two, R is a hyudrocarbylene group;

each $R_2$ is independently hydrogen or an alkyl group having from 1 to about 8 carbon atoms;

b is one or two;

X is oxygen or N—$R_3$;

$R_3$ is independently a hydrocarbyl group having 1 to about 18 carbon atoms or —C(O)$R_4$, $R_4$ is a hydrocarbyl group or a hydrocarbylpolyoxyalkylene alkyl group.

2. The composition of claim 1 wherein the fluorine-containing hydrocarbon (A) is 1,1,1,2-tetrafluroethane.

3. The composition of claim 1 wherein the tertiary amide has a total of not more than twenty-four carbon atoms per carbonyl group, excluding carbon atoms in the polyoxyalkylene groups.

4. The composition of claim 1 wherein a is one and R is a hydrocarbyl group having from 1 to about 18 carbon atoms or a hydrocarbyl polyoxyalkylene alkyl group having from 1 to about 20 oxyalkylene groups and 1 to about 18 carbon atoms in the hydrocarbyl group.

5. The composition of claim 1 wherein a is one and R is a straight-chain hydrocarbyl group having from 1 to about 10 carbon atoms, a branched-chain hydrocarbyl group having from 3 to about 16 carbon atoms.

6. The composition of claim 1 wherein a is two and R is a hydrocarbylene group having from 0 to about 20 carbon atoms.

7. The composition of claim 1 wherein a is two and R is an alkylene group having from 2 to about 10 carbon atoms.

8. The composition of claim 1 wherein each $R_2$ is independently hydrogen, a methyl group or an ethyl group; $R_3$ is a straight-chain hydrocarbyl group having from 1 to about 10 carbon atoms, a branched-chain hydrocarbyl group having from 3 to about 15 carbon atoms, or —C(O)$R_4$ wherein $R_4$ is a straight-chain hydrocarbyl group having 1 to about 10 carbon atoms, a branched-chain hydrocarbyl group having 3 to about 15 carbon atoms, or a hydrocarbyl polyoxyalkylene methyl group having from 1 to about 10 carbon atoms in the hydrocarbyl group and about 2 to about 10 oxyalkylene groups.

9. The composition of claim 1 wherein b is two and X is oxygen.

10. The composition of claim 1 wherein b is two, X is —$NR_3$, and $R_3$ is —C(O)$R_4$, wherein $R_4$ is a straight-chain alkyl group having 1 to about 10 carbon atoms or a branched-chain alkyl group having from 3 to about 15 carbon atoms.

11. The composition of claim 1 wherein (A) is present in an amount from about 70 to about 99% by weight and (B) is present in an amount from about 1 to about 30% by weight.

12. A method for lubricating metal parts, comprising contacting the metal parts with the composition of claim 1.

* * * * *